US007048620B1

(12) United States Patent
Riley et al.

(10) Patent No.: US 7,048,620 B1
(45) Date of Patent: May 23, 2006

(54) SURFACE FINISHING MACHINE AND MOUNTING PLATE THEREFOR

(76) Inventors: James Francis Riley, 21 Shepherd Street, Ridgehaven, South Australia 5097 (AU); Susan Gail McNair, 21 Shepherd Street, Ridgehaven, South Australia 5097 (AU)

( * ) Notice: Subject to any disclaimer, the term of this patent is extended or adjusted under 35 U.S.C. 154(b) by 0 days.

(21) Appl. No.: 09/936,753

(22) PCT Filed: Mar. 17, 2000

(86) PCT No.: PCT/AU00/00212

§ 371 (c)(1),
(2), (4) Date: Sep. 17, 2001

(87) PCT Pub. No.: WO00/54936

PCT Pub. Date: Sep. 21, 2000

(30) Foreign Application Priority Data

Mar. 17, 1999 (AU) ..... PP9267

(51) Int. Cl.
*B24B 23/00* (2006.01)

(52) U.S. Cl. ..... 451/359; 451/353

(58) Field of Classification Search ..... 451/350–359
See application file for complete search history.

(56) References Cited

U.S. PATENT DOCUMENTS

| | | | | |
|---|---|---|---|---|
| 2,950,583 | A * | 8/1960 | Nilsson | 451/508 |
| 3,239,244 | A * | 3/1966 | Leinfelt | 285/7 |
| 3,826,045 | A * | 7/1974 | Champayne | 451/359 |
| 4,328,645 | A * | 5/1982 | Sauer | 451/359 |
| 4,549,371 | A * | 10/1985 | Hakoda | 451/456 |
| 4,671,020 | A * | 6/1987 | Hutchins | 451/357 |
| 4,731,894 | A * | 3/1988 | Ashworth | 15/97.1 |
| 4,759,155 | A * | 7/1988 | Shaw | 451/524 |
| 5,070,656 | A * | 12/1991 | Brogden | 451/353 |
| 5,458,532 | A * | 10/1995 | Cannone | 451/353 |
| 5,609,516 | A * | 3/1997 | Courson et al. | 451/456 |
| 6,494,772 | B1 * | 12/2002 | Barnes et al. | 451/353 |

FOREIGN PATENT DOCUMENTS

| | | | |
|---|---|---|---|
| DE | 3422848 | A1 | 1/1985 |
| DE | 4023464 | A1 | 1/1992 |
| DE | 19614525 | A1 | 10/1996 |
| EP | 0252552 | A1 | 1/1988 |
| GB | 2191429 | A | 12/1987 |

* cited by examiner

*Primary Examiner*—M. Rachuba
(74) *Attorney, Agent, or Firm*—R. Neil Sudol; Henry D. Coleman; William J. Sapone

(57) ABSTRACT

Disclosed is a surface finishing pad (59) having a dust extraction aperture (60). The pad may have multiple finishing areas (63) or a number of pads may be mounted to a mounting plate (48, 62) that is driven by orbital drive means. The dust extraction apertures align (60) with vacuum ports through which dust may be carried away from a surface undergoing finishing. The mounting plate (48) may have a plurality of channels (46) to direct dust to vacuum ports for extraction. The pad and the machine disclosed, which uses the pads, allows large areas to be finished without dust clogging the pads.

30 Claims, 16 Drawing Sheets

SURFACE FINISHING MACHINE AND MOUNTING PLATE THEREFOR

FIELD OF THE INVENTION

The invention disclosed herein relates to a surface finishing machine. It also relates to surface finishing pads for use with the surface finishing machine. The surface finishing machine may be used for sanding, burnishing, polishing and the like of surfaces such as timber, stone, acrylic and the like. The surface may be, amongst others, bench tops and floors. Without intending to limit the invention the application of finishing a solid surface, that is, an acrylic bench top will be used as explanative of the invention. It will be appreciated that the invention is applicable to other applications and other surfaces.

The processes of sanding, burnishing, polishing and the like of surfaces is collectively referred herein as "surface finishing". In a similar manner a pad for use during surface finishing, such as a sanding pad, will generically be referred to as a "surface finishing" pad.

BACKGROUND OF THE INVENTION

Known surface finishing machines are random orbital rotating machines which typically utilise a disc. The disc or surface finishing pad may be a sanding disc, a microfine finishing disc, or buffing disc depending upon the particular application. For sanding and micro finishing large diameter discs have been tried but have tended to be unusable because of clogging with dust. Accordingly, the largest known discs are about 203 mm in diameter which seem to be relatively unaffected by clogging. However, these discs mean that the area processed at any time is relatively small and so the time taken to process a surface is relatively long. Further, the use of these discs can lead to an uneven surface unless extreme care and thus time are taken. Also, it is very difficult to use these discs without scuffing the surface which leads to extra time being spent repairing the surface.

It is also known for surface finishing machines to have a dust collection system. These have essentially a chassis about a mounted disc about which a partial vacuum is created for conducting dust to a collection vessel.

It is also known that finishing pads may take shapes other than circular or disc like.

It is a proposed object of this invention to provide a surface finishing pad with multiple finishing areas, a surface finishing pad with an aperture therethrough for dust extraction, a mounting plate with multiple mounting areas for mounting surface finishing pads, and a surface finishing machine to obviate or minimise at least one of the aforementioned problems, or at least provide the public with a useful choice.

SUMMARY OF THE INVENTION

The invention may be said to reside, not necessarily in the broadest or only form, in a surface finishing pad adapted for mounting to a mounting plate, the surface finishing pad including a dust extraction aperture therethrough and said dust extraction aperture being adapted to align with a vacuum port of a mounting plate.

In a preferred form the surface finishing pad is a disc. In other forms the surface finishing pad may take other shapes such as rectangular.

The invention may also be said to reside, again not necessarily in the broadest or only form, in surface finishing pad including at least one dust extraction aperture therethrough, a plurality of finishing areas proud of an intervening web, the surface finishing, pad being mountable to a mounting plate having at least one vacuum port with which the dust extraction aperture or dust extraction apertures are adapted to align, and the surface finishing pad being adapted such that dust tends to progress into the proximity of the web and may therefrom be extracted through the dust extraction aperture or dust extraction apertures by vacuum dust extraction means.

In one form the surface finishing pad is circular and adapted to be mountable to a mounting plate driven by a random orbital means.

In another form the dust extraction aperture or at least one of the dust extraction apertures is within the web. In yet another form the dust extraction aperture or at least one of the dust extraction apertures is within a one of the finishing areas.

In one form the finishing areas are radially spaced about the centre of the surface finishing pad.

The invention may also be said to reside, again not necessarily in the broadest or only form, in a mounting plate for a surface finishing machine including at least one vacuum port, a plurality of mounting areas proud of an intervening web and adapted to have mounted thereto surface finishing pads, and the mounting plate being adapted such that dust tends to progress into the proximity of the web and may therefrom be extracted through the vacuum port or vacuum ports by vacuum dust extraction means.

According to one form, the mounting plate is disc like.

In another form the mounting areas are circular and adapted to receive mounted thereto surface finishing pads. These surface finishing pads or discs may take known forms.

In one form the mounting plate has therethrough a vacuum port within the web portion for communication with dust extraction means adapted to extract dust from the web portion. In another form the mounting plate has therethrough a vacuum port within one of the mounting areas for communication with dust extraction means adapted to have mounted thereto a surface finishing pad with an aperture therethrough adapted to align with the vacuum port and thereby being adapted to extract dust from the vicinity of the said mounting area. In yet a further form, the mounting plate has channels within at least one of the mounting areas extending from the web portion and adapted to conduct dust from the vicinity of the said mounting area to the web portion for extraction therefrom.

In one form the mounting areas are radially spaced about the centre of the mounting plate.

The invention may also be said to reside in a surface finishing machine including either the before mentioned surface finishing pad or the before mentioned mounting plate and random orbital drive means adapted to drive the surface finishing pad or mounting plate.

In one form the machine includes vacuum port means and connection means adapted to facilitate vacuum dust extraction.

BRIEF DESCRIPTION OF THE DRAWINGS

To assist in the understanding of the invention preferred embodiments will now be described with reference to the accompanying drawings.

DETAILED DESCRIPTION OF THE INVENTION

Figure 1:
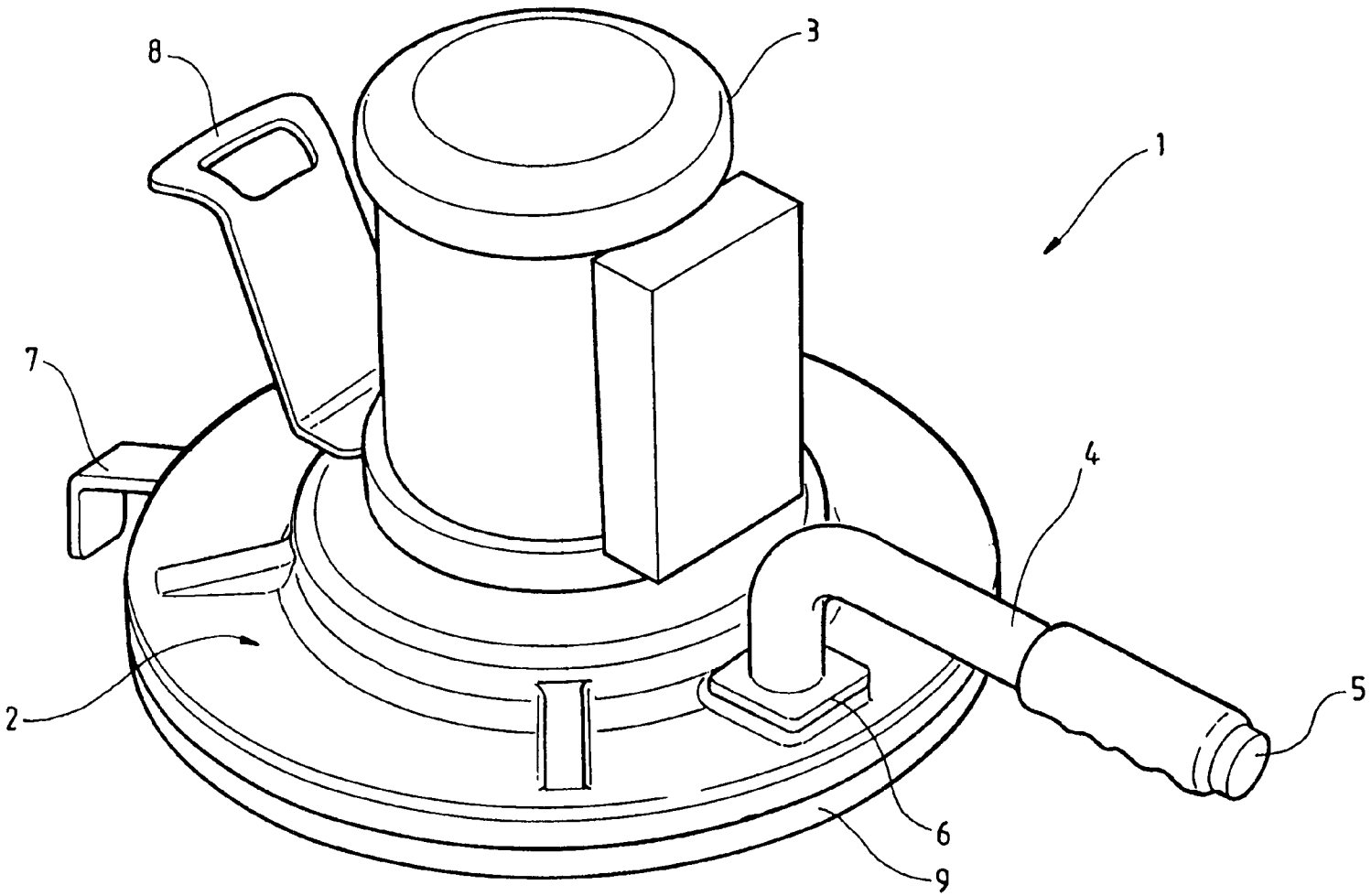
FIG. 1 is a perspective sketch of a surface finishing machine.
Figure 2:
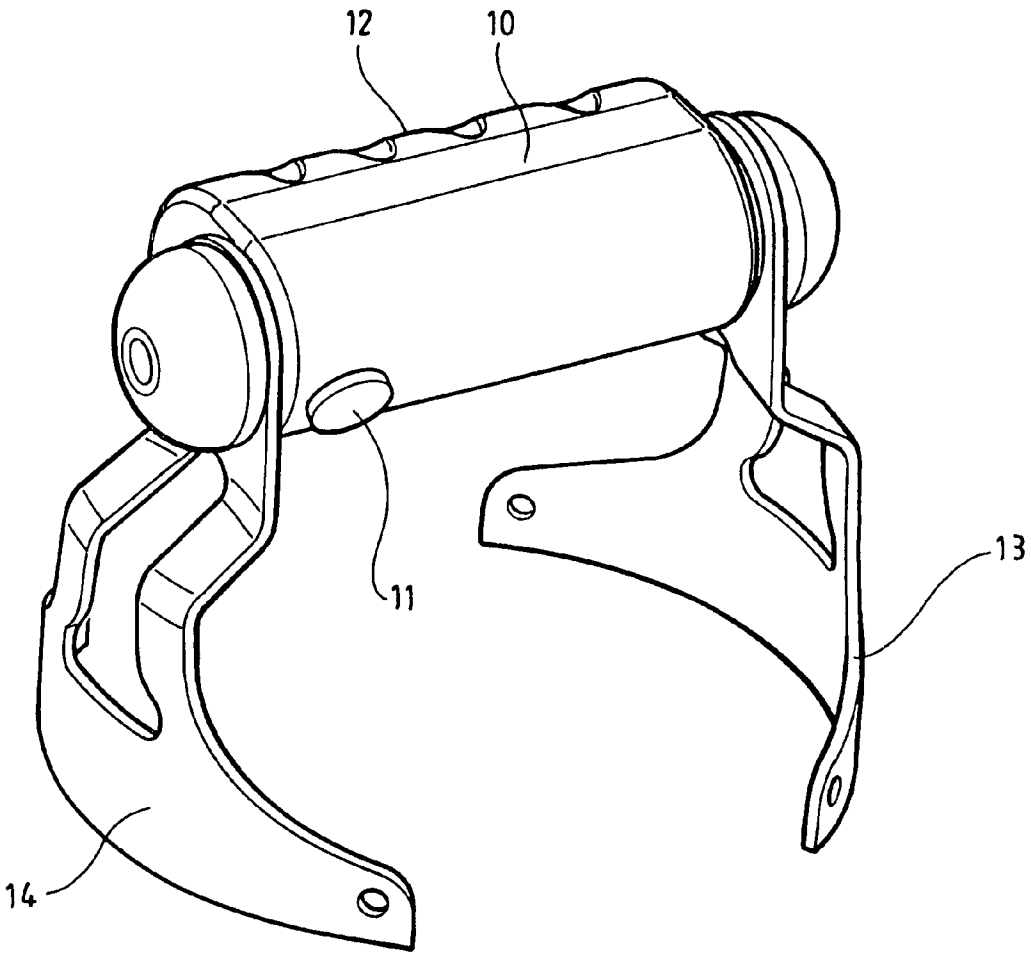
FIG. 2 is a sketch of a handle for the top of the machine shown in FIG. 1.
Figure 3:
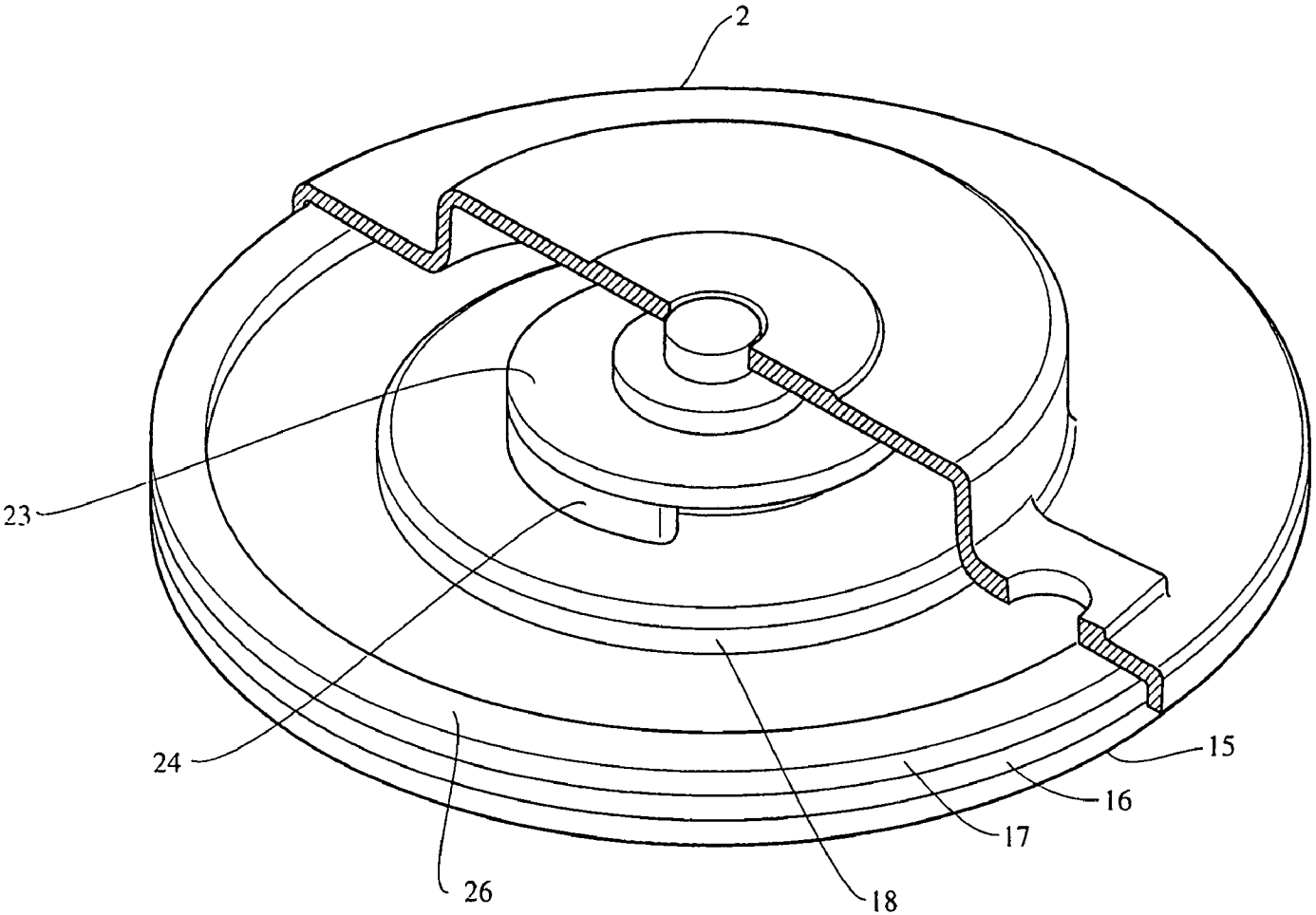
FIG. 3 is a perspective sketch in cut away form of the machine with motor not drawn.
Figure 4:
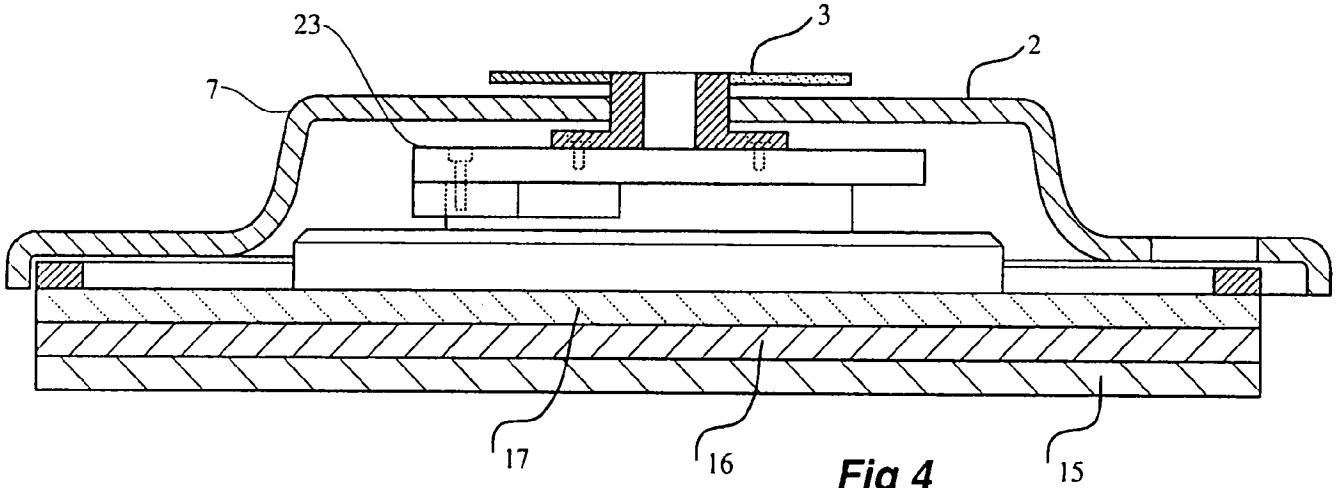
FIG. 4 is a cross sectional sketch of the machine with the motor not drawn.
Figure 5:
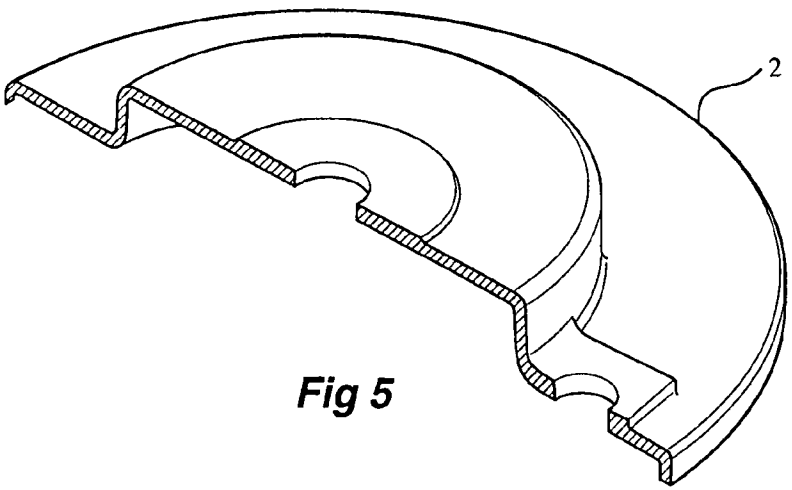
FIG. 5 is a perspective sketch in cut away form of the chassis.
Figure 6:
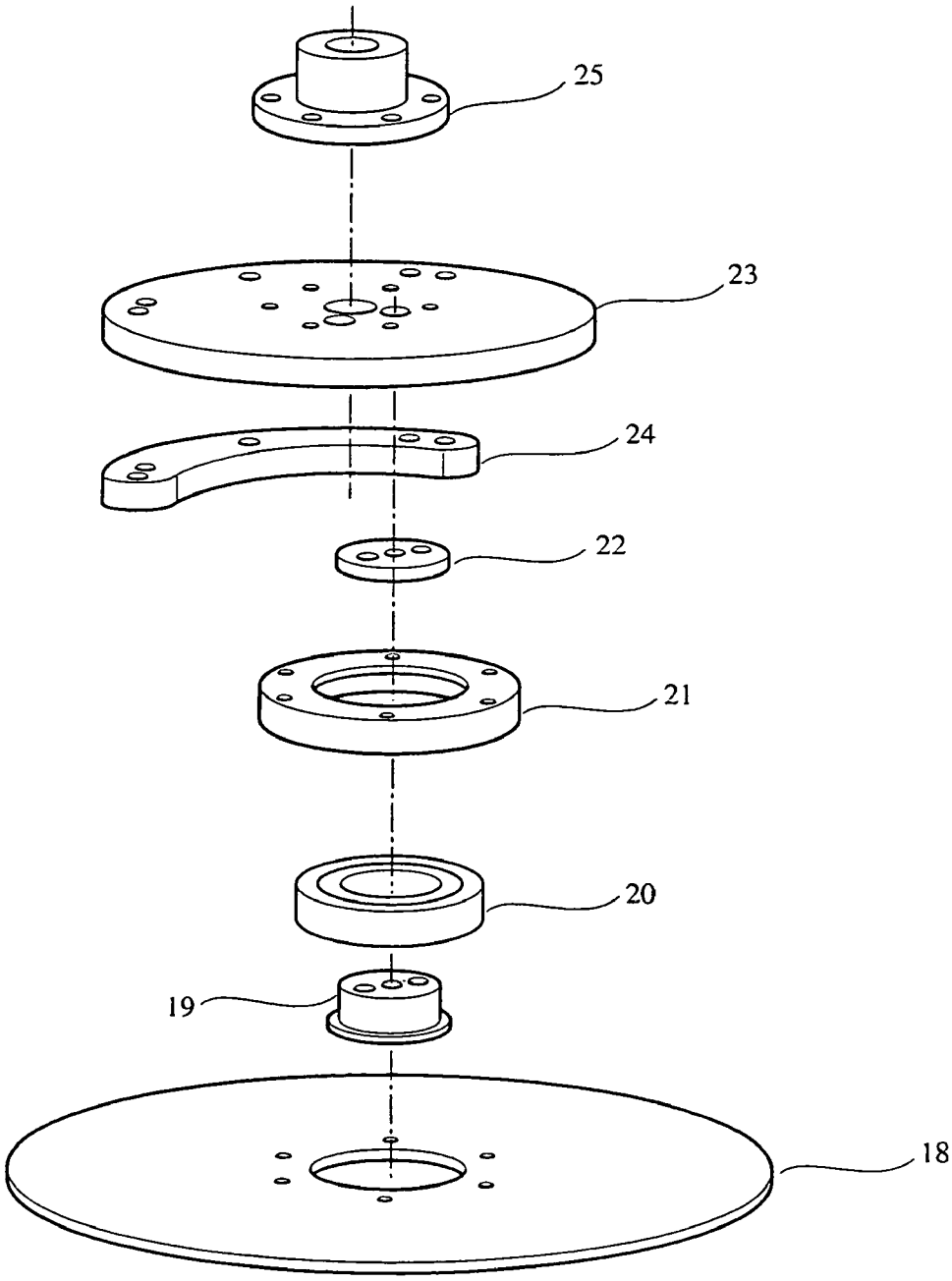
FIG. 6 is a disassembled view of the transmission train from motor boss to base plate.
Figure 7:
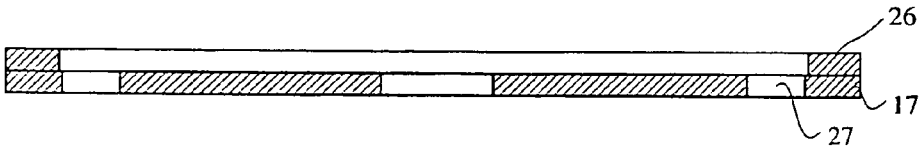
FIG. 7 is a cross sectional view of the fibre board disc.
Figure 8:
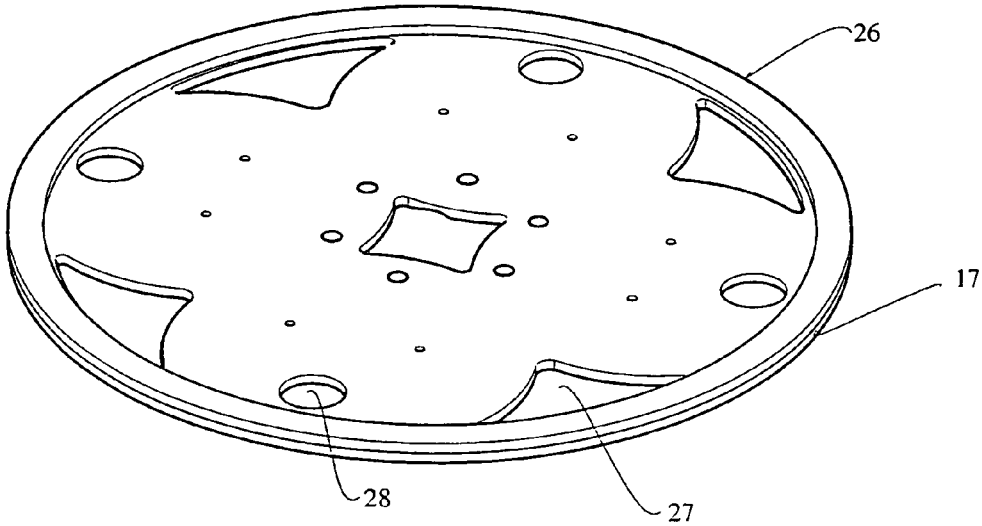
FIG. 8 is a sketch of a perspective view of the fibre board disc.

It will be appreciated that the accompanying drawings are sketches and not engineering design drawings. The intention is to assist understanding of the invention and so perspective or features may be distorted or omitted for clarity. Throughout the drawings the same reference numeral will be used to refer to the same or similar feature.

The surface finishing machine depicted in the figures is of configuration for finishing a bench top.

The machine (1) has a chassis (2) upon which is mounted a 550 W electric motor (3) which operates at 1450 rpm. Extending from the chassis is a side handle (4) with a vacuum connection (5) at one end for connection with a vacuum dust extraction system.

The side handle is tubular and provides a conduit from within and beneath the chassis to the vacuum system. The side handle is mounted by a mating flange (6) and bolts to the chassis. Whilst only one connection to the extraction system is shown for this embodiment a number may be provided if desired. For example a plurality of radially spaced apertures within the chassis may be provided and connected by hosing to a single hose which leads to the external vacuum extraction system.

Further, for some applications such as buffing the external vacuum extraction system may, as a matter of preference be disconnected.

Also extending from the chassis are two legs (7 and 8) by which the machine may be rested in an upright configuration upon a flat surface thereby allowing access to the mounting plate for surface finishing pad changing.

The machine has an overall width of about 400 mm and can finish about a 360 mm wide portion of a surface at one time. The large width means that a surface can be finished more quickly than when using prior known machines. Further, the width reduces the tendency of unevenness in the finished surface so reducing the time needed to ensure levelness. The weight of the machine is about 25 Kg which means that the weight of the machine is sufficient to press the surface finishing pads against the surface for correct operation. There is no needed for an operator to press the machine against the surface and therefore the risk of scuffing is significantly reduced.

The chassis is made of aluminium and is shaped to fit about and skirt the mounting plate and attached mechanism leaving the discs extending beyond the chassis. In this way the chassis forms a shroud that facilitates dust collection and extraction. Subtending from the lower rim of the chassis is a rubber skirt (9) which makes a partial seal with a surface during operation.

A variation to the just mentioned machine includes a top handle (10) which has a push button (11) on/off switch with which to control the operational state of the electric motor. It will be appreciated that the wiring is not shown but would take known forms apparent to a skilled addressee. The handle includes a moulded hand grip (12) made of resilient material to reduce vibration transmitted to an operator. The top handle is mounted to the top of the motor by arcuate flanges (13 and 14) which mount to the cylindrical side of the motor.

Within the chassis is a mounting plate (15) which is mounted to a foam rubber disc (16) which in turn is mounted to a fibre board disc (17). The rubber disc is about 7 mm thick and provides a resilient backing for the mounting plate whilst the fibre board disc is about 9 mm thick and provides a rigid support therefor.

The fibre board disc is mounted to a base plate (18) of steel the diameter of which is less than that of the fibre board disc to reduce overall machine weight. The fibre board disc acts to extend the diameter of the base plate without adding significant weight to the machine.

The base plate is mounted by bearing centre (19), bearing (20), bearing retainer (21), spacer (22) to main plate (23). The base plate, bearing centre, bearing, bearing retainer and spacer are offset from the centre of the main plate by 10 mm to one side. To the lower surface of the main plate is mounted a crescent shaped counter weight (24), of mass and dimensions to counter balance the offset suspended assembly of base plate and mounting plate and associated parts. The main plate is mounted to the rotor of the motor by boss (25).

Upon the upper surface of the fibre board disc proximal to its perimeter is an annular ring (26) of urethane which substantially acts as a seal with the chassis. The partial vacuum for dust extraction is created within the ring.

From the above it will be appreciated that the electric motor drives the main plate at 1450 rpm under normal conditions. The offset mounting of the base plate means that it and its suspended parts orbit the main plate by an eccentric motion of 20 mm from circular. This motion together with the bearing means that the base plate and the suspended parts rotate in a random orbital manner depending upon the surface and experienced load. This arrangement effects an orbital drive means for the mounting plate.

The mounting plate, fibre board disc and rubber disc have aligned apertures therethrough which form vacuum ports (two shown as 27 and 28). These are within the ring of the chassis and communicate with the vacuum extraction system.

The mounting plate is made of urethane, approximately 6 mm thick and is resiliently flexible. It has four radially spaced finishing pad mounting areas (one shown as 29) spaced about its centre each 180 mm in diameter. The pad mounting areas are circular in shape and adapted to have mounted thereto by use of hook and loop means fastener, as commonly known under the trade mark VELCRO, surface finishing pads. The pad mounting areas are proud of the mounting plate by 3 mm interspaced by web portions (30) which are approximately 3 mm thick. Within the mounting areas are channels (one shown as 31) 1 mm deep between the vacuum port and the web portion for conducting dust either to the vacuum port through the mounting areas or to the intervening web portion and thence to a vacuum port therein. The vacuum port within the mounting areas are in this embodiment proximal to the perimeter of the mounting plate where centrifugal force will tend to move dust. The channels are approximately 10 mm wide and are arcuate in profile. Other profiles and widths may be used as desired whilst meeting the object of clearing the dust.

Figure 9:
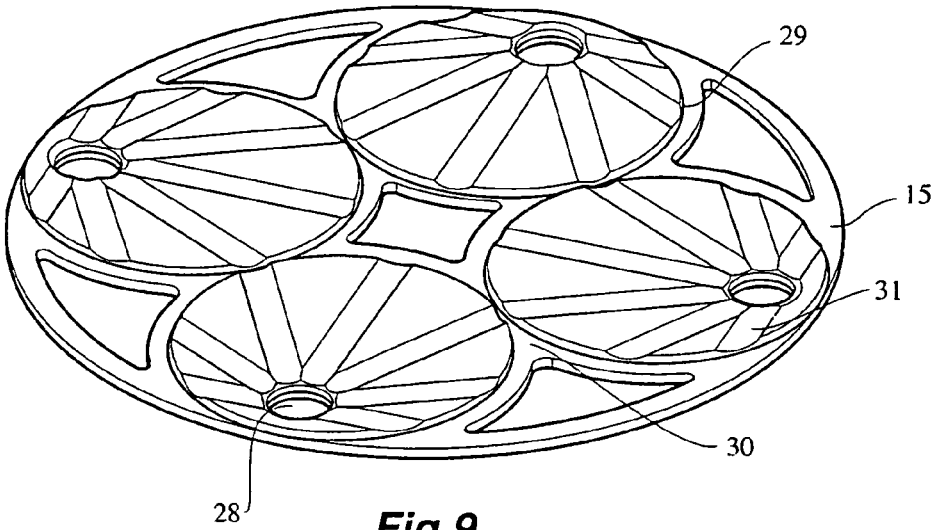
FIG. 9 is a perspective sketch of the mounting plate.
Figure 10:
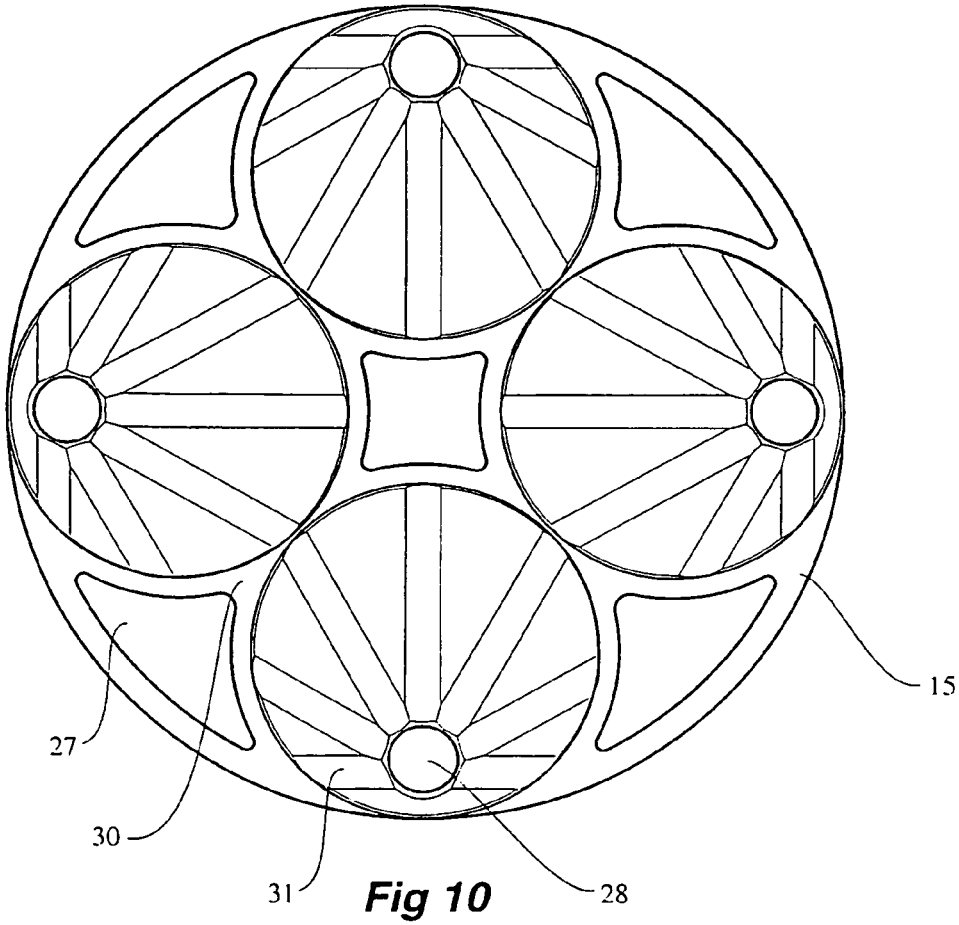
FIG. 10 is a plan view of the mounting plate.
Figure 11:
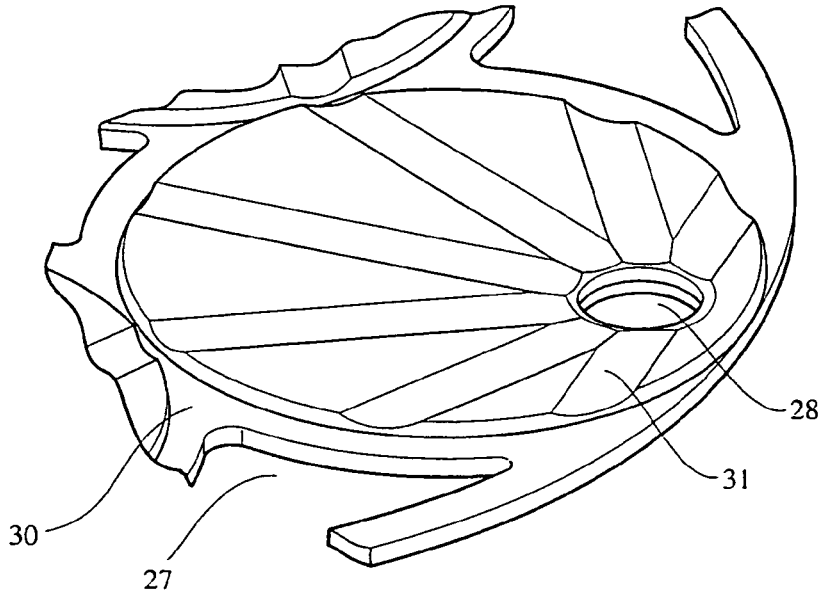
FIG. 11 is a line sketch of a perspective view of a mounting area.
Figure 12:
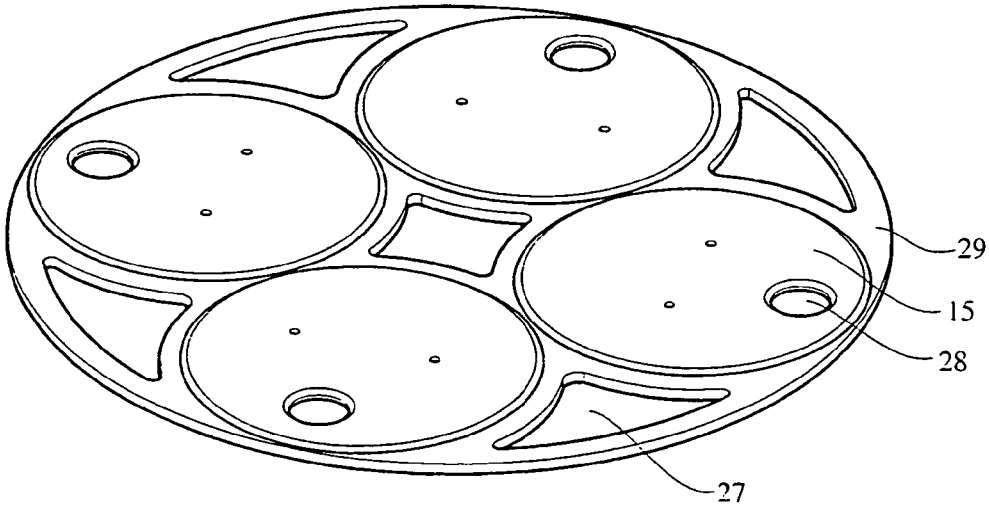
FIG. 12 is a perspective sketch of a second embodiment of the mounting plate viewed from beneath.

A second embodiment of the mounting plate is illustrated in FIG. 12. This mounting plate is of similar construction as that shown in FIG. 9, except that no channels are provided. The vacuum port within the mounting area is positioned further away from the periphery of the mounting area, than that shown for the first embodiment. This is preferred to alleviate the problem of the sanding discs lifting at about that area as a result of the lack of sufficient surface adhesion. This embodiment of the mounting plate is useful where sanding discs are to be attached to the mounting plate by the use of an adhesive rather than VELCRO (trade mark). Sanding discs used in the first embodiment tend to conform to the shape of the mounting area under the influence of the vacuum, however certain sanding pads currently on the market are particularly rigid and will not do so. The second embodiment of the mounting plate can then be used.

Figure 13:
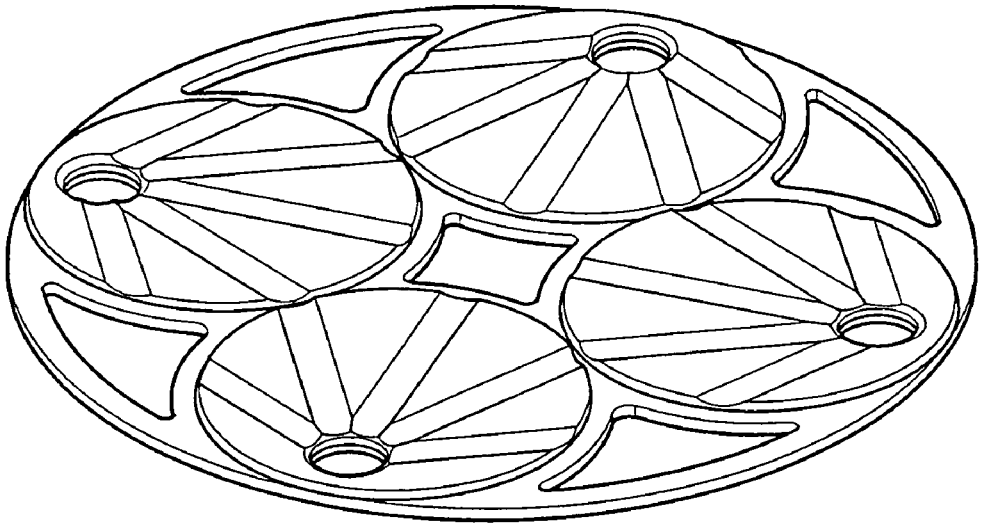
FIG. 13 is a perspective sketch of a third embodiment of the mounting plate viewed from beneath.
Figure 14:
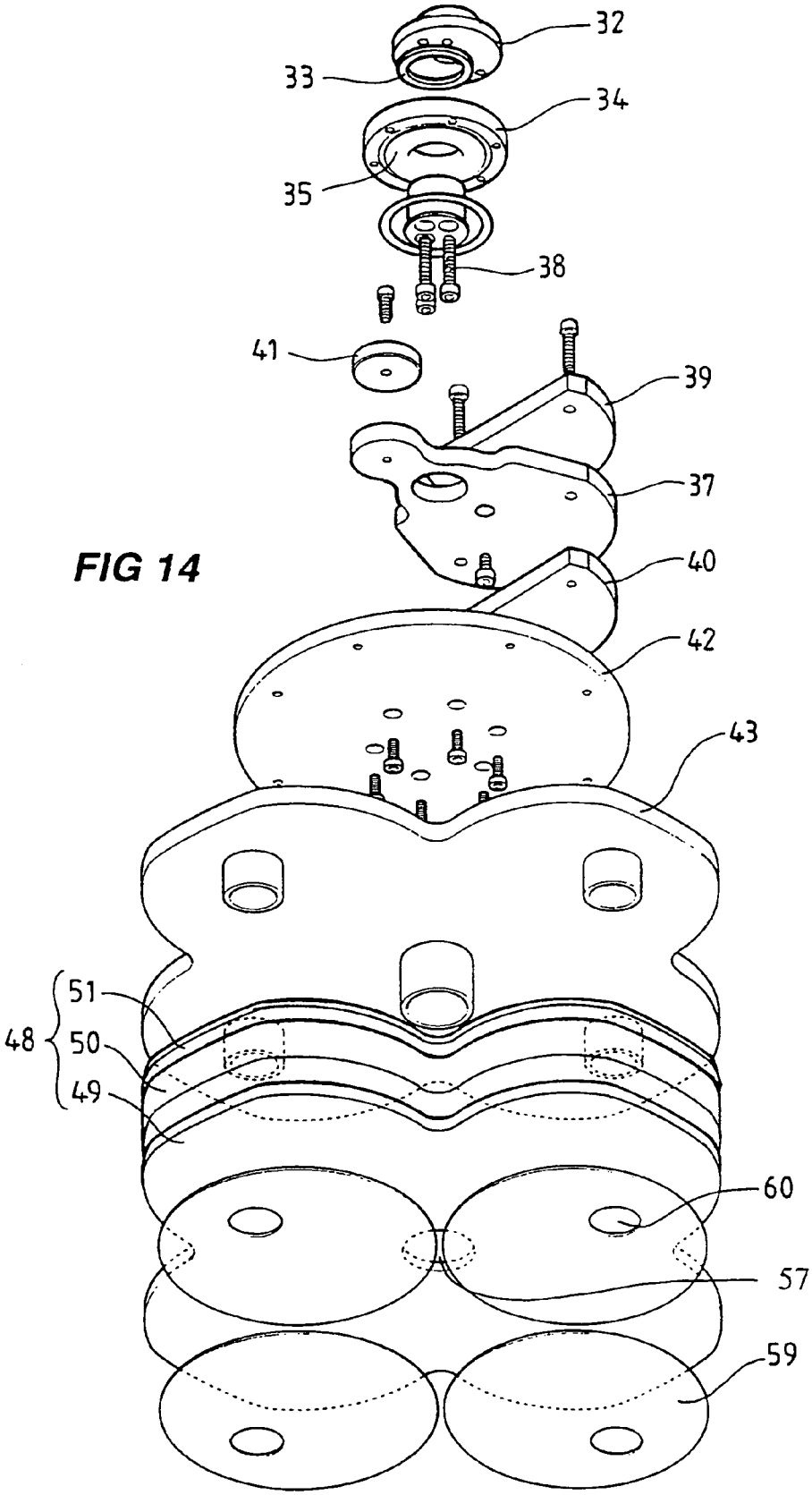
FIG. 14 is a sketch of the disassembled view of a second embodiment of a surface finishing machine.

A third embodiment of the mounting plate is illustrated in FIG. 13. This mounting plate is very similar in construction to the mounting plate shown in FIG. 9. The primary differences are that there are less channels, and that the vacuum port within the pad mounting area is positioned further away from the periphery of the pad mounting area. These modifications are preferred where there are difficulties in providing sufficient adhesion for the pad to stay on the mounting plate during use.

The mounting plate is secured to the fibre board disc by means of radially spaced bolts. This mounting is not shown in all figures but takes a form apparent to a skilled addressee. Discussion concerning another embodiment of a surface finishing machine below mentions and depicts the bolts. In this first embodiment the foam rubber disc has appropriate apertures and is secured in place by the bolts securing the mounting plate to the fibre board disc.

To the mounting areas may be mounted modified standard 180 mm (6 inch) discs that are commonly available within Australia and in at least some overseas countries. These discs, it is intended, will be available with an aperture therethrough to align with the vacuum port within the mounting area.

Alternatively, it is a relatively simple matter to cut a suitable aperture through a prior known disc. Such apertures are not required with polishing or buffing discs where dust is not created to any serious extent.

The second embodiment of the surface finishing machine will now be discussed. The machine is similar to the first and also includes an electric motor, suitable controls, handles and vacuum extraction system. The differences lie within the chassis and these will be discussed.

To the rotor of the motor is mounted a boss (32). There is a spacer (33), bearing retainer (34), bearing (35), bearing centre (36) and main plate (37) which collectively mount the main plate to the boss using bolts (one shown as 38). This is generally as previously described.

Figure 21:
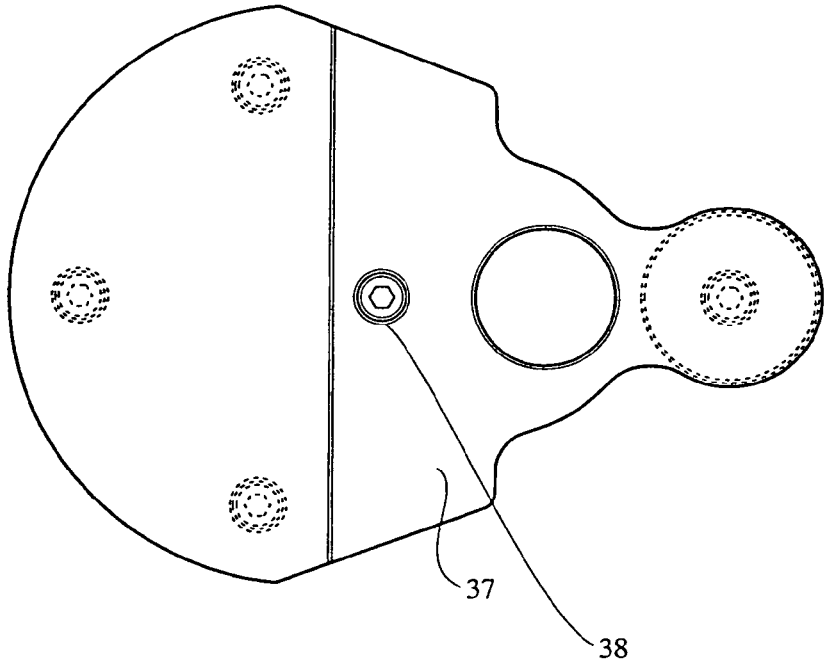
FIG. 21 is a plan view sketch of a base plate including counter weights.
Figure 22:
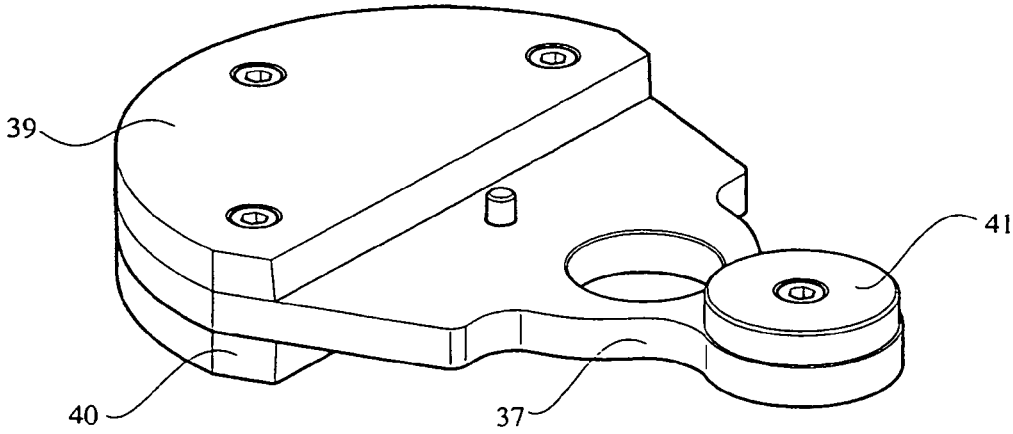
FIG. 22 is a perspective view sketch of the base plate shown in FIG. 21.

The main plate, again made of steel, takes a different shape being best seen in FIG. 21 and is not a circular disc. The weight of the main plate is accordingly reduced. To the main plate is mounted by bolts two counter weights (39 and 40) each being fasten to opposite sides of the main plate. A further countering weight is provided by counter balance (41) which is also bolted to the main plate. It will be appreciated that the function of the main plate is as before and is part of an orbital drive means.

Mounted by bolts to the main plate is a base plate (42) which again is made of steel. The base plate is essentially as previously described and is mounted off centre with respect to the main plate to effect the random orbital motion.

Figure 15:
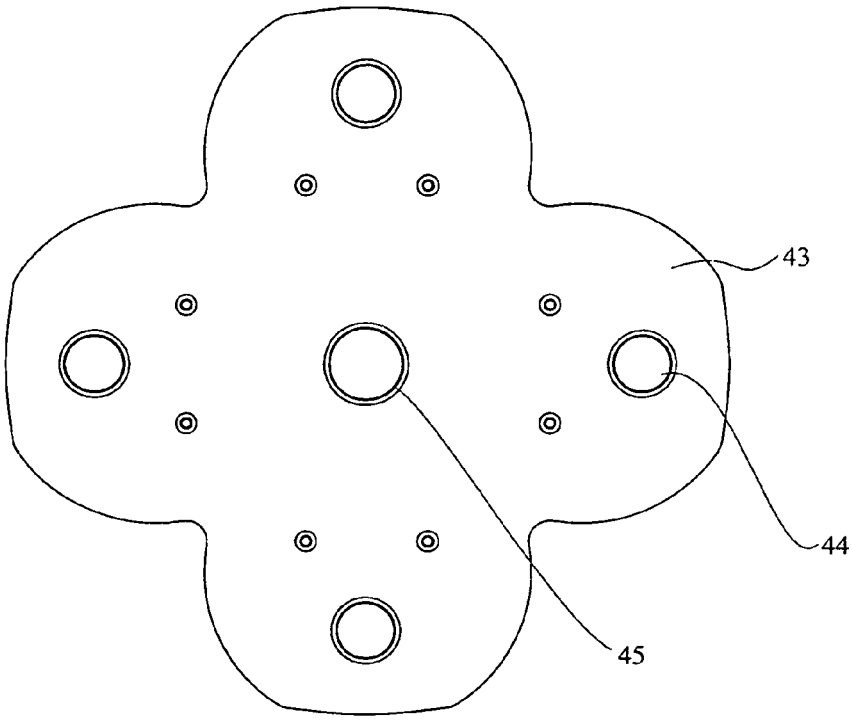
FIG. 15 is a plan view sketch of a fibre board disc.
Figure 16:
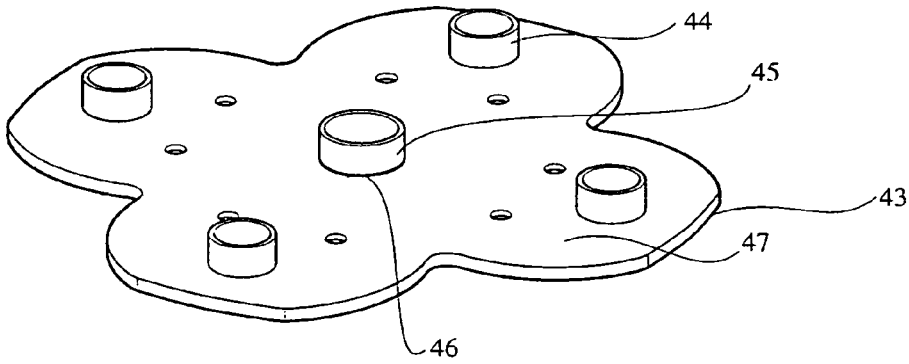
FIG. 16 is a perspective view sketch of the fibre board disc shown in FIG. 15.
Figure 17:
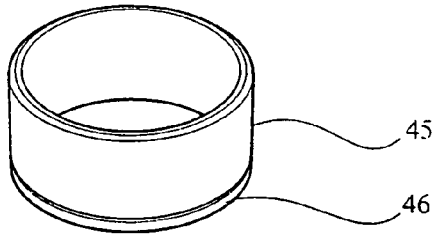
FIG. 17 is a sketch of the central peg shown in FIG. 15.
Figure 18:
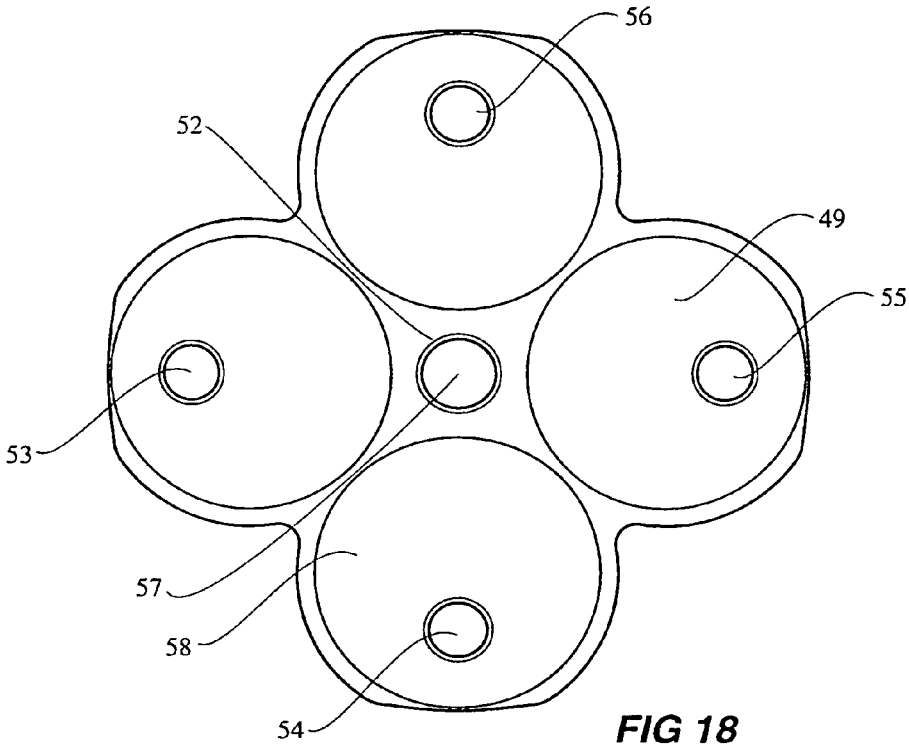
FIG. 18 is a plan view sketch of a mounting plate.
Figure 19:
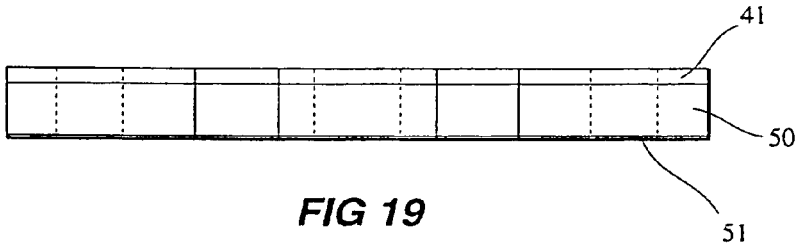
FIG. 19 is a side view sketch of the mounting plate shown in FIG. 18.
Figure 20:
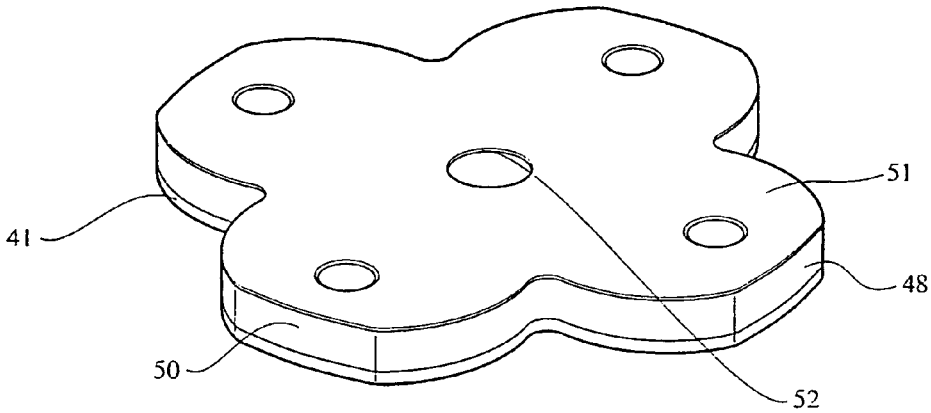
FIG. 20 is a perspective view sketch of the mounting plate shown in FIG. 18.

Mounted by bolts to the base plate is a fibre board disc (43) which in plan view is not circular. Its shape is best seen in FIG. 15. It is 9 mm thick and quite rigid so providing a firm backing to a mounting plate later to be described. Glued to the fibre board disc are four mounting area pegs (one shown as 44) and a central peg (45) all made of P.V.C. cylindrical tubing approximately 33 mm in diameter. These pegs provided registering means for the mounting plate and conduits for the vacuum ports through which dust may be extracted.

The central peg has an external circumferential groove (46) of approximately 0.5 mm depth and 2 mm width. This groove is located so that it is approximately level with but slightly spaced from the surface (47) from which the pegs project. This groove forms part of a fastening means for securing the mounting plate to the fibre board disc.

The mounting plate (48) is of layer construction having a first layer (49) of urethane approximately 6 mm thick, a second layer (50) of foam rubber of approximately 9 mm thickness, and a final layer being a P.V.C. backing plate (51) of approximately 1 mm thickness. These layers are glued together to make a laminated structure.

The foam rubber layer is equivalent to the foam rubber disc of the first embodiment. Likewise with the first layer and the mounting plate of the first embodiment. It will be appreciated that the laminated construction simplifies assembly and disassembly but functionally is the same as the separate components of the first embodiment.

All the layers of the mounting plate include holes to receive the pegs projecting from the fibre board disc. The hole of the backing plate to receive the central peg is slightly smaller that the diameter of the peg, approximately 32 mm compared with approximately 33 mm, so forming a circular detent (52). The backing plate is sufficiently resilient to flex under manual pressure of fitting the mounting plate to allow the central peg to be received and when against the fibre board disc the backing plate clicks into the groove. This prevents unintentional separation of the fibre board disc and the mounting plate whilst allowing easy fitting. The four mounting area pegs register the mounting plate relative to the fibre board disc. The backing plate is also flexible enough to allow for intentional removal of the mounting plate by an operator.

Being able to change the mounting plate allows a number of mounting plates to be prepared and interchanged as required before requiring new surface finishing pads to be fitted. Also, changing mounting plates permits changing from one grade of finishing pad to another including going from sanding to buffing.

Through the mounting plate are vacuum ports (53, 54, 55, 56 and 57) defined by the pegs. There are also four mounting areas (one shown as 58) to which a surface finishing pad (one shown as 59) can be mounted.

Depending upon the application and whether dust is created, the surface finishing pad has a dust extraction aperture (60). The dust extraction aperture aligns with the vacuum port within the respective mounting area. The surface finishing pad may be a modified previously known and commercially available surface finishing pad, the modification being the cutting of the dust extraction aperture.

Figure 24:
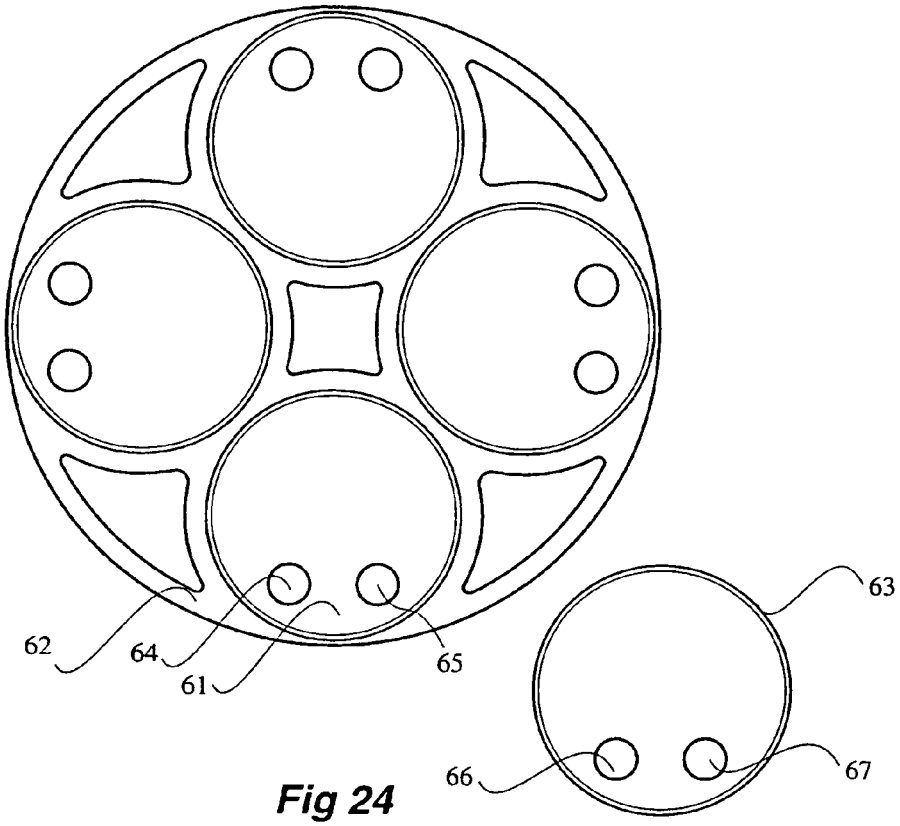
FIG. 24 is a sketch of a mounting plate and a surface finishing pad with two pairs of vacuum ports and dust extraction apertures.

It will be appreciated that each mounting area (one shown as 61) of a mounting plate (62) and respective surface finishing pad (63) may have multiple aligned vacuum port (two shown as 64 and 65) and dust extraction apertures (two shown as 66 and 67) as illustrated in FIG. 24.

Figure 25:
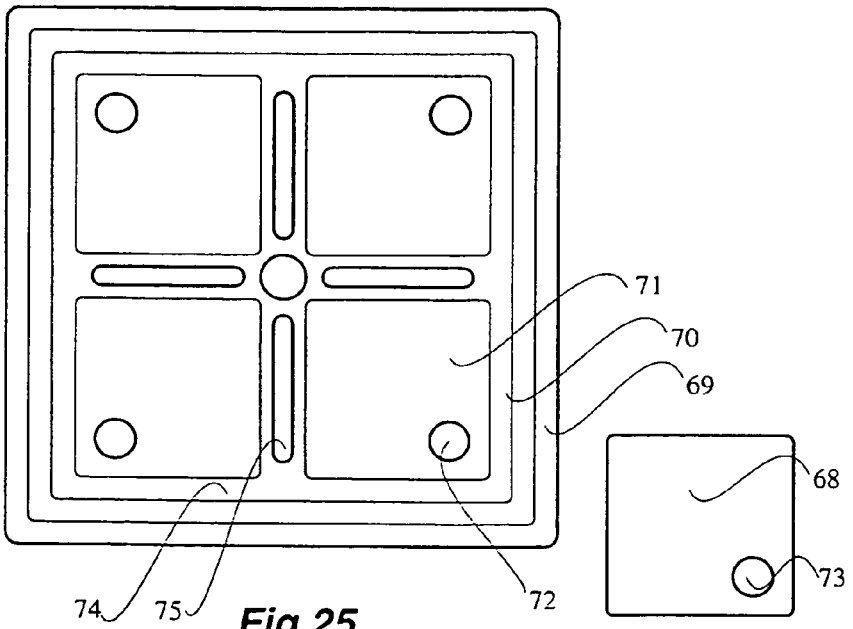
FIG. 25 is a sketch of under view of a surface finishing machine having a generally rectilinear configuration.

Whilst circular surface finishing pads have been described it will be appreciated that the arrangement may be altered to accept rectangular surface finishing pads (68). In this form the surface finishing machine has a chassis (69), fibre board disc and mounting plate (70) with a generally rectilinear configuration. This is illustrated in FIG. 25. The mounting areas (one shown as 71) has a vacuum port (one shown as 72) and the surface finishing pad may have a respective dust extraction aperture (73). Within the mounting plate are other vacuum ports through the web (74) interconnecting the mounting areas including rectangular ports (one shown as 75) between mounting areas.

Figure 23:
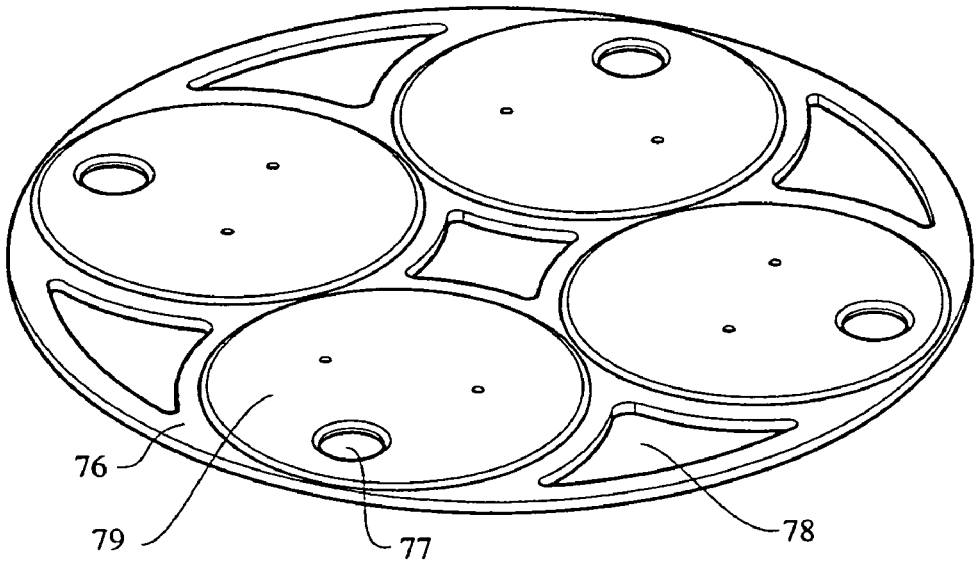
FIG. 23 is a perspective sketch of a further embodiment of a surface finishing pad viewed from beneath.
Figure 26:
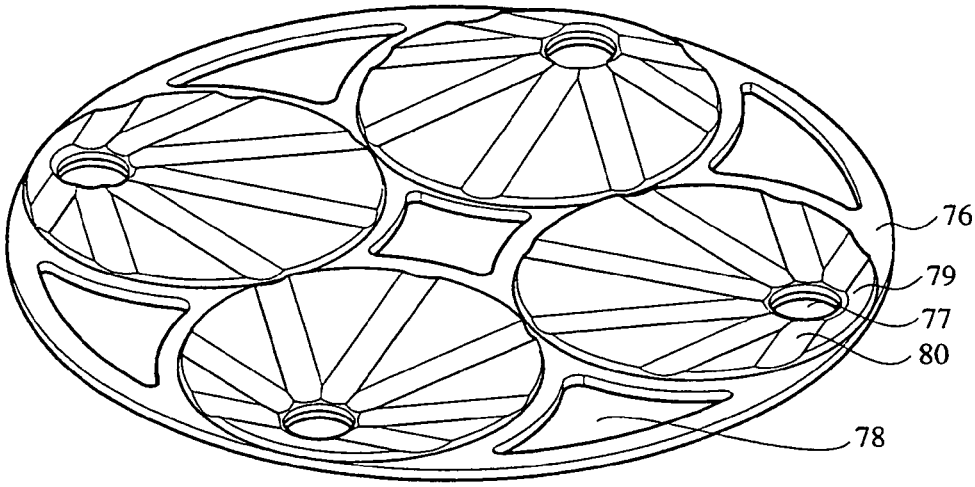
FIG. 26 is a perspective sketch of a further embodiment of a surface finishing pad viewed from beneath; and, FIG. 27 is a perspective view sketch of a further embodiment of a mounting plate adapted to mount three surface finishing pads.
Figure 27:
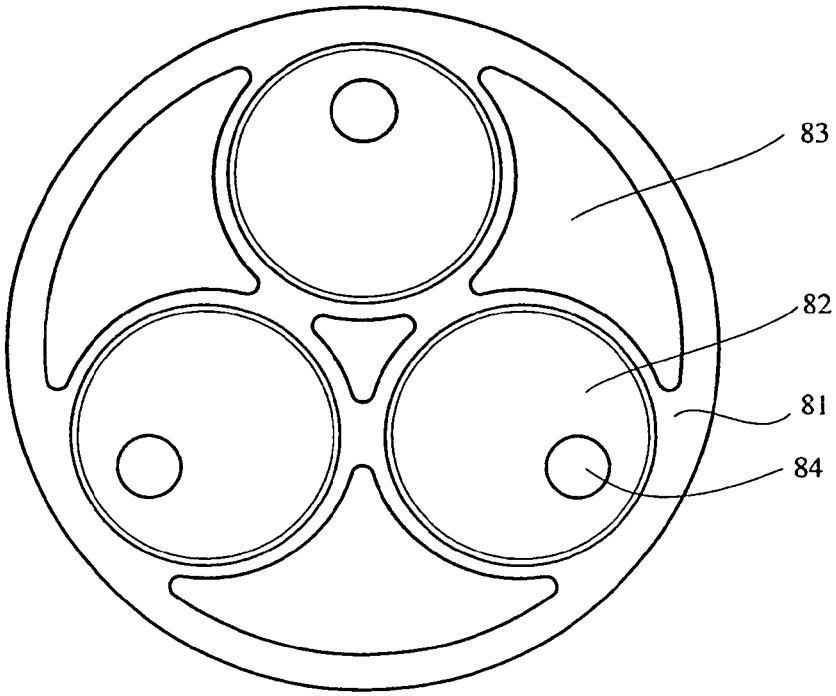

It will be appreciated that due to currently available discs it is preferred to mount separate discs to the pad mounting areas. However, it is envisaged that discs may be made to cover the whole mounting plate whilst providing for operation as hereinbefore explained. FIG. 23 illustrates a surface finishing pad (76) made of a suitable material such as urethane which would be mounted to a flat faced mounting plate through which suitable vacuum ports exist to align with the dust extraction apertures (two shown as 77 and 78). The surface finishing pad has four raised surface finishing areas (one shown as 79) upon which is the finishing material. The surface finishing pad may include channels (one shown as 80) which effect the same function as the previously described channels as illustrated in FIG. 26.

The mounting plate (81) illustrates the use of three mounting areas (one shown as 82) with vacuum ports (two shown as 83 and 84). Apart from the number of the mounting areas and appropriate changes to the number and location of vacuum ports this configuration is essentially the same a previously described.

It will also be appreciated that with an appropriate handle longer than that previously illustrated, the machine just described can be converted to be used for floor operation with the operator being able to stand during use.

Other variations to the just described embodiment will be apparent to the skilled addressee including the provision of mounting areas spaced about two or more rings about the centre of the mounting plate thereby allowing a greater area to be finished at any time.

It will be appreciated that this disclosure is not intended to limit the invention to the preferred embodiment or details thereof. It is intended to give an overview of the invention as conceived and other embodiments will be apparent to the skilled addressee all of which fall within the spirit of the invention.

The invention claimed is:

1. A mounting plate for a surface finishing machine, the mounting plate comprising at least one vacuum port, a plurality of mounting areas proud of or raised above an intervening web and adapted to have mounted thereto surface finishing pads, and the mounting plate being adapted such that dust tends to progress into the proximity of the web and may therefrom be extracted through the vacuum port or vacuum ports by vacuum dust extraction means, the mounting plate further comprising a plurality of layers between an external surface upon which the mounting areas lie and a rear surface, and the plurality of layers including a first layer made of urethane and having the mounting areas and a second layer of resilient material.

2. A mounting plate as in claim 1 wherein the vacuum port or at least one of the vacuum ports is within the web.

3. A mounting plate as in claim 1 wherein the vacuum port or at least one of the vacuum ports is within a one of the mounting areas.

4. A mounting plate as in claim 1 wherein the mounting areas are integral with the web.

5. A mounting plate as in claim 1 wherein the mounting areas are formed separately from the web and are fitted thereto so that the mounting areas are proud of or raised above the web.

6. A mounting plate as in claim 1 wherein the center of the mounting plate is part of the web.

7. A mounting plate as in claim 6 wherein the mounting areas are radially spaced about the center of the mounting plate.

8. A mounting plate as in claim 7 including at least three mounting areas.

9. A mounting plate as in claim 8 including four mounting areas.

10. A mounting plate as in claim 1 wherein the vacuum port or at least one of the vacuum ports fits over a hollow cylindrical dust extraction peg, the dust extraction peg having an external circumferential groove, and the mounting plate including a thin backing plate with a peg aperture of diameter slightly smaller than the external diameter of the peg and adapted to receive the dust extraction peg, and the thickness and resiliency of the backing plate being such that the mounting plate may be pushed onto and pulled off the dust extraction peg and when secured relative to the dust extraction peg the backing plate resides within the groove.

11. A surface finishing machine comprising a chassis, a mounting plate, random orbital drive means adapted to drive the mounting plate, the chassis shrouding the mounting plate and having a downwardly open aperture for exposing the mounting plate to a surface to be finished, the mounting plate having a plurality of layers between an external surface and a rear surface, the plurality of layers including a middle layer of a foamed resilient material, and an external layer and a rigid internal layer for connection with the drive means, the machine further comprising:

at least one vacuum port communicating between the external surface and rear surface of the mounting plate, and dust extraction means in communication with the vacuum port, the external layer comprising a plurality of spaced mounting areas proud of or raised above an intervening web of an external surface of the external layer, said mounting areas being attached or attachable to surface finishing pads, such that in use dust tends to progress into the proximity of the web and is extracted therefrom through the vacuum port by the vacuum dust extraction means.

12. A surface finishing machine as in claim 11 wherein the mounting areas are formed separately from the web and are fitted thereto so that the mounting areas are proud of or raised above the web.

13. A surface finishing machine as is claim 11 wherein said at least one vacuum port extends through the mounting plate to define a conduit therethrough, the dust extraction means including at least one vacuum aperture adapted to align with a vacuum port conduit, and vacuum connection means connecting the aperture to a vacuum source.

14. A surface finishing machine as in claim 13 wherein the vacuum connection means includes at least one hollow cylindrical dust extraction peg, the dust extraction peg adapted to align with the vacuum port conduit, the mounting plate including a thin backing plate with a peg aperture of diameter slightly smaller than the external diameter of the peg and adapted to receive the dust extraction peg, and the thickness and resiliency of the backing plate being such that the mounting plate may be pushed onto and pulled off the dust extraction peg and when secured relative to the dust extraction peg the backing plate resides within an external circumferential groove on the peg.

15. A surface finishing machine as in claim 11 including a base plate connected to the random orbital drive means and adapted to receive the mounting plate.

16. A surface finishing machine as in claim 14 wherein the at least one peg is attached to an intermediate disc onto which the mounting plate is fitted.

17. A surface finishing machine as in claim 15 wherein the random orbital means includes at least one eccentrically driven weight, and the base plate is connected off center with respect to said weight to thereby result in a random orbital motion of the base plate.

18. A surface finishing machine as in claim 11 wherein the chassis also includes a flexible skirt extending from a lower edge of the chassis, the flexible skirt adapted to form a partial vacuum seal with a surface during operation.

19. A surface finishing machine as in claim 11 wherein said at least one vacuum port is a gap between the periphery of the mounting plate and the chassis.

20. A surface finishing machine as in claim 11 wherein the resilient layer of the mounting plate is made of a foamed rubber.

21. A surface finishing machine as in claim 11 wherein the mounting plate is removable.

22. A surface finishing machine as in claim 12 wherein the mounting areas include an abrasive or polishing surface fitted thereto.

23. A mounting plate for a surface finishing machine, the mounting plate including at least one vacuum port extending therethrough, the mounting plate having a plurality of layers between an external surface and a rear surface, the plurality of layers including a middle layer of a foamed resilient material, an external layer and a relatively rigid internal layer for connection with a drive means of the surface finishing machine, the external layer comprising a plurality of spaced mounting areas being proud of or raised above an intervening web of an external surface of the external layer, said mounting areas being attached or attachable to surface finishing pads, so that in use dust tends to progress into the proximity of the web and may therefrom be extracted through the vacuum port.

24. A mounting plate as in claim 23 wherein the mounting areas are integral with the web.

25. A mounting plate as in claim 23 wherein the mounting areas are formed separately from the web and are fitted thereto so that the mounting areas are proud of or raised above the web.

26. A mounting plate as in claim 23 wherein the mounting areas are radially spaced about a center of the mounting plate.

27. A mounting plate as in claim 26 including at least three mounting areas.

28. A mounting plate as in claim 26 including four mounting areas.

29. A surface finishing machine as in claim 23 wherein the resilient layer for the mounting plate is a foamed rubber.

30. A surface finishing machine as in claim 23 wherein the mounting areas include an abrasive or polishing surface fitted thereto.

* * * * *